US008838631B2

(12) United States Patent
Kobayashi et al.

(10) Patent No.: US 8,838,631 B2
(45) Date of Patent: Sep. 16, 2014

(54) FACILITY MANAGEMENT SYSTEM USING GEOGRAPHIC INFORMATION SYSTEM

(75) Inventors: Mitsuaki Kobayashi, Tokyo (JP); Fumio Kurosaki, Tokyo (JP)

(73) Assignee: JR East Consultants Company, Tokyo (JP)

( * ) Notice: Subject to any disclaimer, the term of this patent is extended or adjusted under 35 U.S.C. 154(b) by 214 days.

(21) Appl. No.: 13/000,188

(22) PCT Filed: Sep. 25, 2008

(86) PCT No.: PCT/JP2008/067229

§ 371 (c)(1), (2), (4) Date: Dec. 22, 2010

(87) PCT Pub. No.: WO2010/035319

PCT Pub. Date: Apr. 1, 2010

(65) Prior Publication Data

US 2011/0167076 A1 Jul. 7, 2011

(51) Int. Cl.
*G06F 17/30* (2006.01)
*B61L 27/00* (2006.01)

(52) U.S. Cl.
CPC ..... *B61L 27/0088* (2013.01)
USPC ..... 707/758; 707/744

(58) Field of Classification Search
CPC combination set(s) only.
See application file for complete search history.

(56) References Cited

U.S. PATENT DOCUMENTS

| | | | | |
|---|---|---|---|---|
| 6,178,377 | B1 * | 1/2001 | Ishihara et al. | 701/446 |
| 2004/0111213 | A1 * | 6/2004 | Iwamura et al. | 701/208 |
| 2006/0265350 | A1 * | 11/2006 | Klein | 707/1 |
| 2010/0188216 | A1 * | 7/2010 | Nielsen et al. | 340/540 |

FOREIGN PATENT DOCUMENTS

| | | | |
|---|---|---|---|
| JP | 2002092109 | A | 3/2002 |
| JP | 2003167919 | A | 6/2003 |
| JP | 2006256545 | A | 9/2006 |
| JP | 2006321277 | A | 11/2006 |
| JP | 2007017240 | A | 1/2007 |
| JP | 2008037270 | A | 2/2008 |

* cited by examiner

*Primary Examiner* — Anteneh Girma
*Assistant Examiner* — Miranda Huang
(74) *Attorney, Agent, or Firm* — Harness, Dickey & Pierce, PLC

(57) ABSTRACT

A facility management system has a facility GIS database configured with electronic map data and facility management GIS data containing data for identifying a location and a form of a facility located along a railway or a road, a facility register database configured to manage a name of a rail or a road, a kilometer post and attribute information in association with one another, and a kilometer post information management section configured to manage coordinate data of the facility on the general map and the kilometer post in association with each other. When searching for attribute information from the facility register database, the kilometer post information management section is referred to obtain kilometer post information by using the coordinate data of the facility and the attribute information of the facility is searched from the facility register database by using the kilometer post information.

25 Claims, 10 Drawing Sheets

(A) Railway facility 1: rail
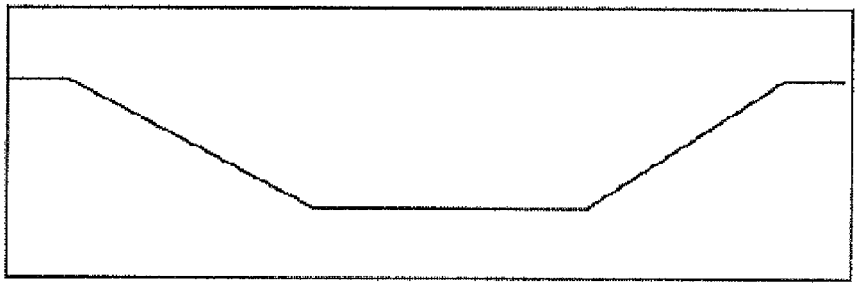
(B) Railway facility 2: kilometer post
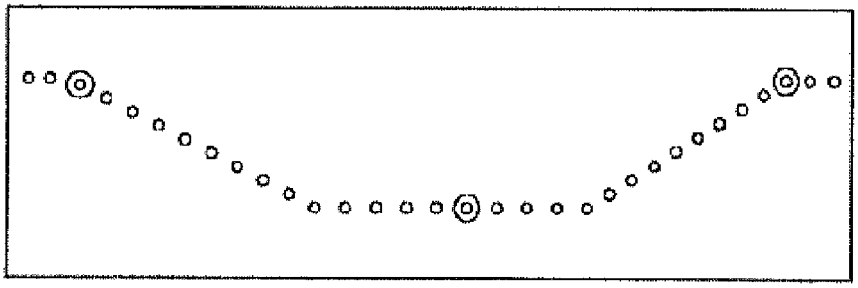
(C) Railway facility 3: station
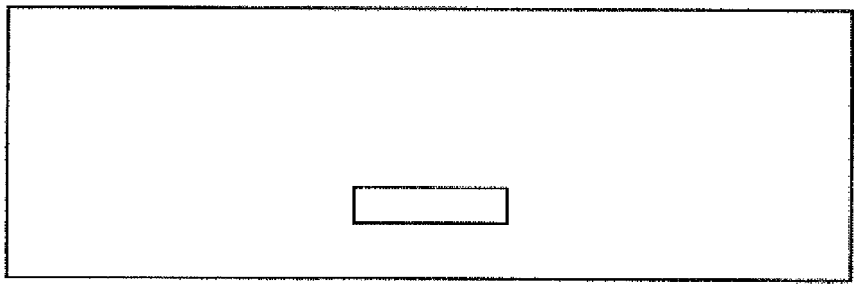
(D) Railway facility 4: bridge
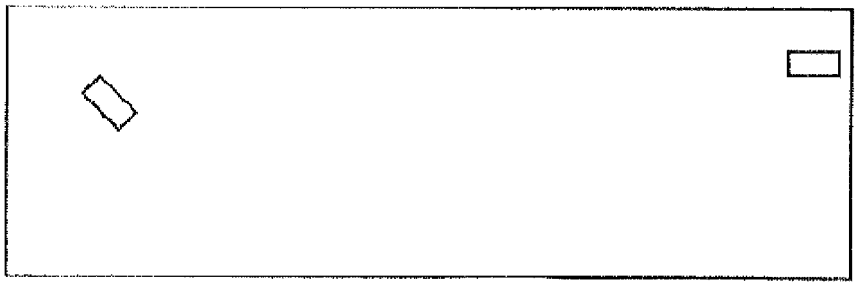
FIG.5

Kilometer post DB

| rail name | kilometer post | X coordinate | Y coordinate |
|---|---|---|---|
| XX line | 00kXXXm | XXX | 000 |
| | | | |

FIG.6

(A) bridge maintenance register DB

| ID | rail name | kilometer post | bridge name | maintenance history | drawing ID |
|---|---|---|---|---|---|
| B-1 | XX line | △△kXXXm | 00 | year-month-day | DW1 |
| B-2 | | | | | |
| B-3 | | | | | |
| ⋮ | ⋮ | ⋮ | ⋮ | ⋮ | ⋮ |

(B) tunnel register DB

| ID | rail name | kilometer post | tunnel name | length | ··· | drawing ID |
|---|---|---|---|---|---|---|
| T-1 | XX line | △△kXXXm | 00 | 500m | | DW10 |
| T-2 | | | | | | |
| T-3 | | | | | | |
| ⋮ | ⋮ | ⋮ | ⋮ | ⋮ | ⋮ | ⋮ |

(C) railway crossing register DB

| ID | rail name | kilometer post | railway crossing name | ··· |
|---|---|---|---|---|
| K-1 | XX line | △△kXXXm | 00 | |
| K-2 | | | | |
| K-3 | | | | |
| ⋮ | ⋮ | ⋮ | ⋮ | ⋮ |

(D) traffic signal register DB

| ID | rail name | kilometer post | up line | down line |
|---|---|---|---|---|
| S-1 | XX line | △△kXXXm | 0 | |
| S-2 | | | | |
| S-3 | | | | |
| ⋮ | ⋮ | ⋮ | ⋮ | ⋮ |

FIG.7 drawing DB

| ID | rail name | general drawing | construction drawing | bar arrangement drawing |
|---|---|---|---|---|
| DW1 | XX line | 1～10 | 11～100 | 101～120 |
| DW2 | | | | |
| DW3 | | | | |
| | ⋮ | ⋮ | ⋮ | ⋮ |

FIG.8

FACILITY MANAGEMENT SYSTEM USING GEOGRAPHIC INFORMATION SYSTEM

TECHNICAL FIELD

The present invention relates to a facility management system for managing various facilities associated with railways/roads by using a geographic information system (GIS).

BACKGROUND ART

The Geographic Information System (GIS) is known as a technology for comprehensively managing and processing data (spatial data) containing information relating to a location by using a geographic location, and for displaying the data visually thereby to allow advanced and rapid judgment. There is proposed an information management system for associating an object (land or building) displayed on an electronic map with a document file relating to the object via a computer system (for example, see patent document 1). In the information management system, the GIS for linking map information and attribute information collaborates with a document file system for managing document files containing detail information of objects. In order to allow easy access to the map and documents, an object ID is given to each object, a unique document ID is given to each document and the object IDs and the document IDs are linked on one-to-one basis in a document link database.

Here, in a railway or a road and its surrounding area, there exist numerous infrastructures (hereinafter referred to as "railway and other facilities") managed by infrastructure owners or operators. Among the railway and other facilities, railway facilities may include stations, tunnels, bridges, tracks, railway crossings, traffic signals, various pole braces, kilometer post signs (kilo Post), CTC devices, train radio base stations, and other equipment. Besides, the road facilities may include traffic signals, tunnels, bridges, elevated bridges, service areas, information boards, kilometer post signs (kilo Post) and other equipment.

[Patent document 1] Japanese Patent Application Laid-open No. 2003-167919 (related art)

[Patent document 2] Japanese Patent Application Laid-open No. 2006-321277 (related art)

DISCLOSURE OF THE INVENTION

Meanwhile, the present inventors proceed to digitize paper-based rail plans drafted in the past. Each rail plan is drafted for one railway line. The rail plan contains not only rails (tracks) as a center and its surrounding land features, houses, roads, rivers and the like, but also railway facilities that are not shown in a general map.

The railway facilities are different from typical objects (lands, buildings and houses), thus there is no coordinate data and detailed maps for identifying absolute locations of such railway facilities on the map, except for fixed asset such as stations. Therefore, when linking a railway facility on the digitalized rail plan and attribute information of the railway facility, it is required to assign coordinate data for identifying the absolute location on the map to a document relating to the railway facility managed in various forms. As to the railway facilities, there exist a vast number of railway facilities in a vast area along the railways or roads. Therefore, there is a problem that it requires enormous costs and efforts to assign the coordinate data on the map to each of all railway facilities managed by the document file system.

Further, in the railway business, owning and operating of the railway facilities (asset) have been conducted by the same organization, however, it is expected that operation model of separation between Railway Infrastructure and Railway Operation, in which an owner and an operator of the railway facilities are different organizations, increases. Maintenance of the railway facilities is conducted by the operator, and necessary investment can be made at the discretion of the operator (operator bears the cost). For example, it is considered that rail equipment originally constructed in a ballast structure is modified to a slab track by capital investment of the operator in order to reduce maintenance cost. In association with such a modification, the original fixed asset is retired and an asset of the operator is newly added. That is, in a railway of the separation between Railway Infrastructure and Railway Operation, plural organizations respectively hold assets.

Although the information of railway facilities (fixed asset register, asset drawings and the like) can be digitalized and managed by the asset management system, it has not been achieved to link the railway facility information managed by the asset management system and the railway facilities on the digitalized rail plan. In order to link the railway facilities managed by the asset management system and the railway facilities on the digitalized rail plan, much costs and labors are required.

The present invention has an object to provide a facility management system capable of managing a railway/road facility or the like on a geographic information system by easily linking the facility on a map and attribute information of the facility, without assigning coordinate data on the map of the facility to the attribute information of the facility.

The facility management system using the geographic information system of the present invention comprises: a facility GIS database configured with electronic map data for displaying a general map, and facility management GIS data containing data for identifying a location and a form of a facility located on a railway or a road on the general map; a facility register database configured to manage a name of a rail or a road where the facility is located, a kilometer post representing a distance from a reference point on the rail or the road where the facility is located, and attribute information of the facility other than the kilometer post and the name of the rail or the road, in association with each other; and an attribute search section configured to, when searching for the attribute information of the facility from the facility register database, search for attribute information of a search target facility from the facility register database by using kilometer post information assigned in advance to the search target facility.

According to the present invention, it is possible to reduce the complicated work for setting coordinate data on the general map to each facility registered in the railway facility register database, to search for the attribute information based on the kilometer post of the railway facility, and finally to facilitate management of the attribute information of a huge number of facilities existing on each rail or each road.

The above-described facility management system may be such that the facility GIS database has a layer structure in which the facility management GIS data is layered by facility types.

The above-described facility management system may further comprise a receiving section configured to receive a request from a client device via a communication network; and a distributing section configured to distribute the electronic map data and the facility management GIS data, which are retrieved from the facility GIS database, to the client device in response to the request received by the receiving section.

The above-described facility management system may be such that when the client device requests attribute information of a facility by designating coordinate data of the facility, the attribute search section is configured to search for the attribute information of the facility designated by the client device from the facility register database, and transmit the attribute information to the client device via the distributing section.

The above-described facility management system may further comprise a data obtaining section configured to, when the client device requests attribute information of a facility by designating a facility type and a map area of the facility, coordinate data of each facility which has the designated facility type and located in the map area from the facility management GIS data, the attribute search section is configured to search for the attribute information of each facility, of which the coordinate data is obtained by the data obtaining section, from the facility register database, and transmit the retrieved attribute information to the client device via the distributing section.

BRIEF DESCRIPTION OF THE DRAWINGS

FIG. 5 is diagrams illustrating display information of railway facilities;

FIG. 6 is a configuration diagram of a kilometer post database in the above-mentioned embodiment;

FIG. 7 is configuration diagrams of various databases in the above-mentioned embodiment;

FIG. 8 is a configuration diagram of a drawing database in the above-mentioned embodiment;

BEST MODE FOR CARRYING OUT THE INVENTION

The present invention will be described below by way of an exemplary embodiment of a GIS base railway facility management system.

Figure 1:
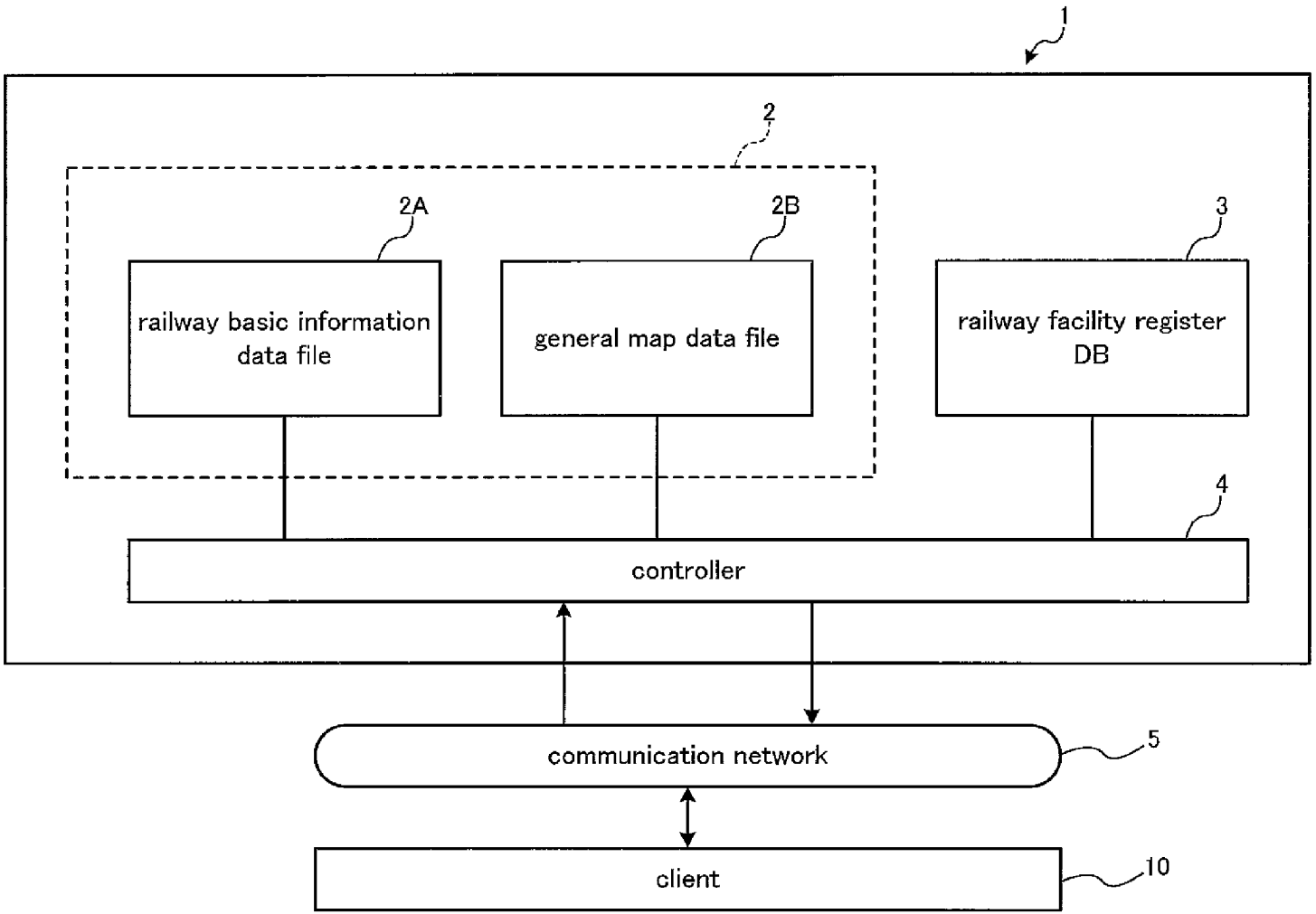
FIG. 1 is a general diagram of a railway facility management system according to an exemplary embodiment.

FIG. 1 is a general diagram of a railway facility management system according to the present embodiment. The railway facility management system 1 has a map data file 2 that comprises GIS data for railway facility management, a railway facility register database 3 that is digitized registers relating to various railway facilities are digitized, and a controller 4 that retrieves GIS data and attribute information from the map data file 2 and the railway facility register database 3 to create data for displaying in clients. The map data file 2 is configured with a railway basic information data file 2A storing railway basic information and a general map data file 2B that is a digitized general map. The railway basic information contains information for identifying the location and form of a railway facility on the general map. In this embodiment, GIS data for railway facilities is stored as divided into the railway basic information data file 2A and the general map data file 2B, however the railway basic information data file 2A and the general map data file 2B may not be divided but be combined.

A client device 10 accesses the railway facility management system 1 via a communication network 5 to obtain information for railway facility management. A communication network 5 connects the railway facility management system 1 and the client device 10 to permit data communication. The communication network 5 may be Internet, Intranet, LAN, public telephone network, any other network or a combination of any of them.

Figure 2:
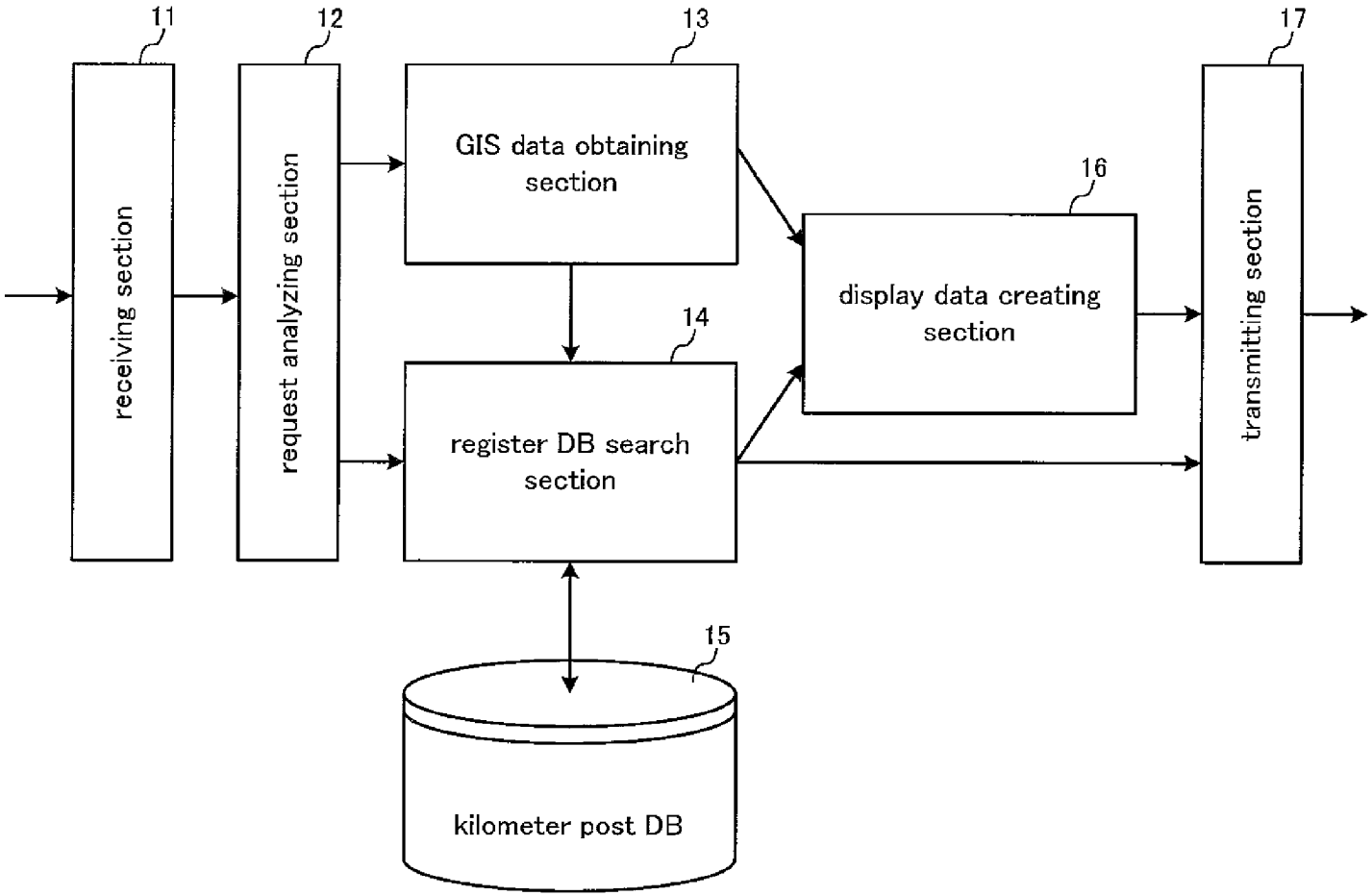
FIG. 2 is a schematic diagram of a functional block of a controller in the above-mentioned embodiment.

FIG. 2 is a schematic diagram of a functional block of the controller 4. The controller 4 may comprise a server device. The controller 4 has a receiving section 11 for receiving a request signal from the client device 10 via the communication network 5 and a request analyzing section 12 for analyzing the request signal received by the receiving section 11. A GIS data obtaining section 13 obtains corresponding railway basic information and/or general map data from the railway basic information data file 2A and the general map data file 2B in response to the request given from the request analyzing section 12. A register DB search section 14 retrieves, in response to the request given from the request analyzing section 12, location data (coordinate data on the general map) of a railway facility as a search target from the GIS data obtaining section 13 or the request analyzing section 12, converts the coordinate data into kilometer post information with reference to a kilometer post database 15 and obtains register information (attribute information) of the targeted railway facility from the railway facility register database 3 based on the kilometer post information. A display data creating section 16 edits the map data (containing railway basic information) given from the GIS data obtaining section 13 and/or a search result (attribute information) given from the register DB search section 14 to generate client display data or output the data file itself (e.g. drawing data) to a transmitting section 17. The transmitting section 17 distributes the map data and attribute information to the requesting client device 10.

Figure 3:
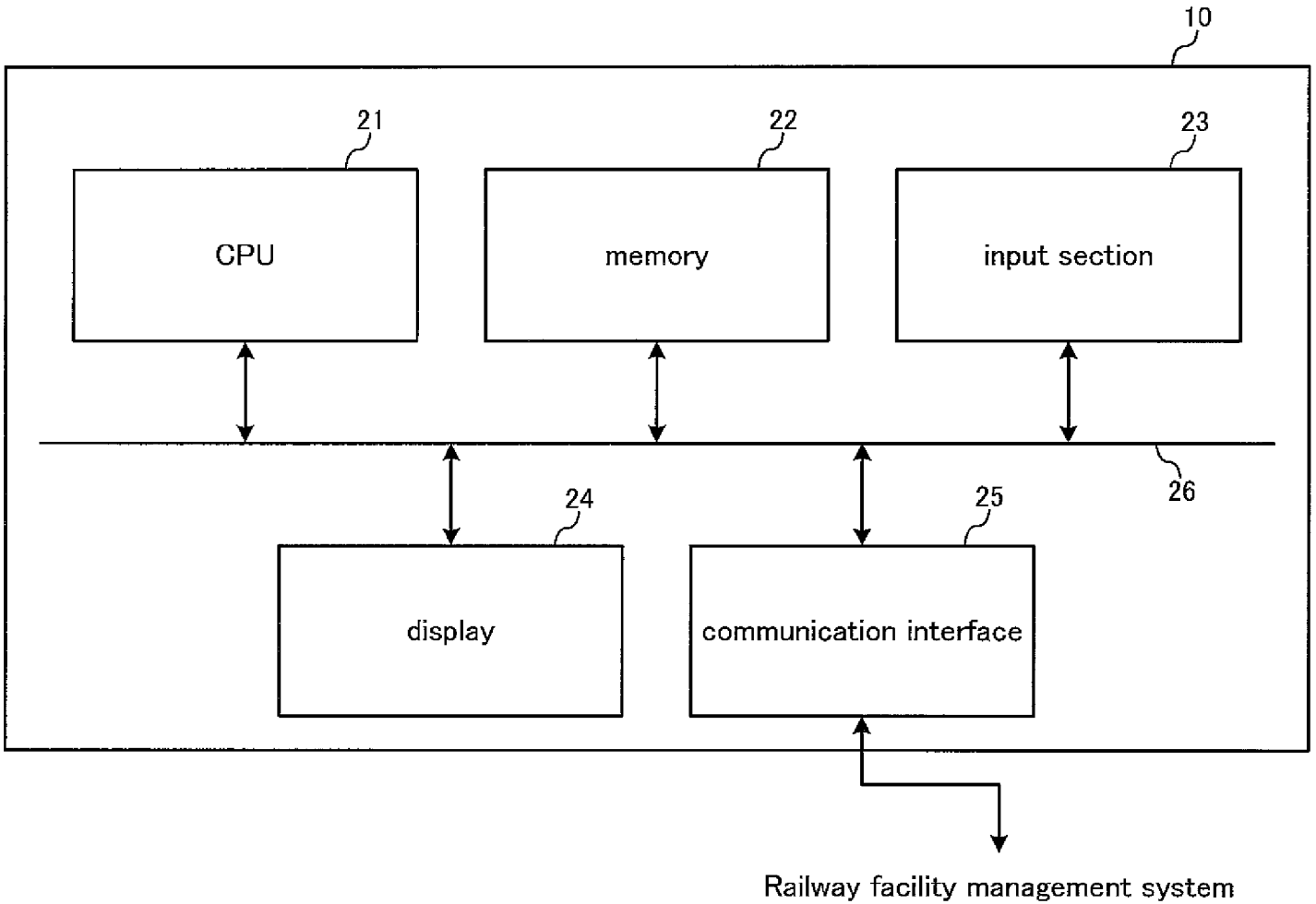
FIG. 3 is a functional block diagram of a client device in the above-mentioned embodiment.

FIG. 3 is a functional block diagram of the client device 10. The client device 10 may set up by a personal computer. Specifically, the client device 10 may comprise a CPU 21 for executing a program to perform processing for displaying various image data relating to railway facility management, a memory 22 for storing the program, an input section 23 such as a keyboard and a mouse, a display 24, a communication interface 25 and an internal bus 26.

Figure 4:
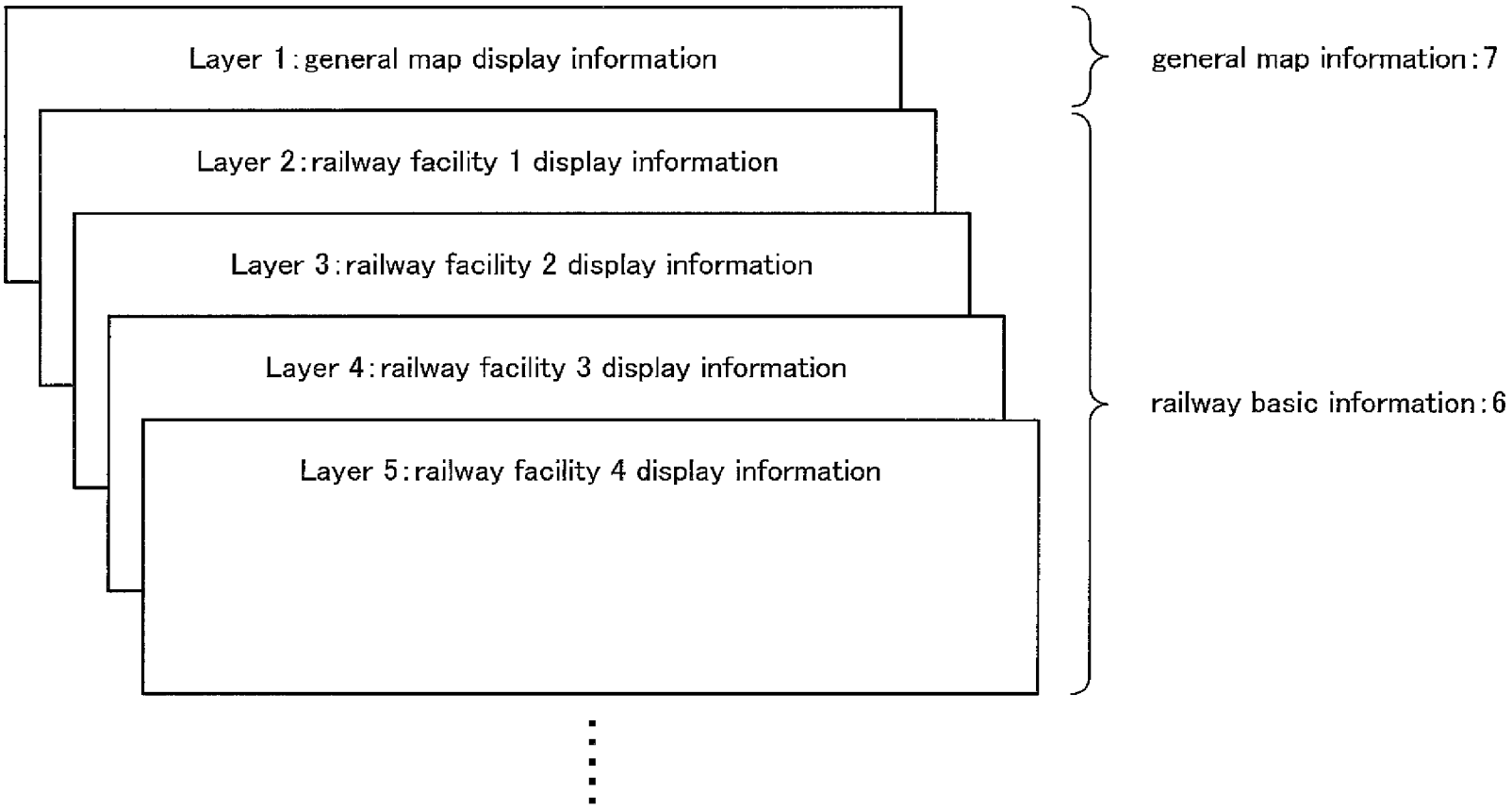
FIG. 4 is a diagram illustrating a layer structure of railway basic information and general map information.

As illustrated in FIG. 4, the railway facility management system 1 manages the railway basic information 6 stored in the railway basic information data file 2A and the general map information 7 stored in the general map data file 2B in a layer structure. In this example, the layer 1 contains the general map display information and the layer 2 and later layers contain railway facility display information. For example, the display information of the layers 1 to 5 are selected and overlapped one on another, thereby GIS data for railway facilities, in which railway facilities 1 to 4 are overlapped, is generated while maintaining a relative positional relationship on a predetermined area of street map.

The railway basic information 6 may contain a railway facility (including small equipment) or the like which may be freely selected. For example, the railway basic information 6 may include rails, kilometer posts, track centers, bridges, tunnels, stations, station platforms, railway crossings, traffic signals, poles (including electric poles), buildings around the rails and rail surrounding areas. Here, the kilometer post represents a position in the track center on each rail by a distance from the reference point of the rail. The kilometer post may be represented as "** k xxx m", although the format of the kilometer post is not limited.

As illustrated in FIGS. 5(A) to 5(D), the railway basic information 6 is layered by respective types of railway facilities, and the location and form of respective railway facilities are identified on the general map. In this embodiment, rail information is stored as the railway facility 1 (FIG. 5(A)), kilometer post information is stored as the railway facility 2 (FIG. 5(B)), station information is stored as the railway facility 3 (FIG. 5(C)), and bridge information is stored as the railway facility 4 (FIG. 5(D)).

FIG. 6 is a configuration diagram of the kilometer post database 15. The kilometer post database 15 registers, for each rail name, the distance (kilometer post) from the reference point of each of kilometer posts (kilo posts) set up along the rail at given intervals and coordinate data (X coordinate, Y coordinate) on the general map of the kilometer post in association with each other. The database structure may not necessarily be adopted as far as the kilometer post in each rail and the coordinate on the general map are associated with each other.

Next description is made about a configuration of the railway facility register database 3. Here, the description is made by way of examples of a bridge maintenance register database, a tunnel register database, a railway crossing register database, a traffic signal register database and a drawing database, which are not intended for limiting the kind of register of the present invention.

FIG. 7(A) is a diagram illustrating a configuration example of bridge maintenance register database. In the bridge maintenance register database, maintenance data of a bridge installed on each rail is registered. In the bridge maintenance register database illustrated in FIG. 7(A), a rail name of a rail where the bridge is installed, kilometer post information representing the installation location of the bridge on the rail by the kilometer post, a name of the bridge, maintenance history information of the bridge and an ID number of a drawing file of the bridge are registered. The railway facility management system 1 may use the rail name and kilometer post information to search for desired bridge data from much bridge data registered in the bridge maintenance register database.

FIG. 7(B) is a diagram illustrating a configuration example of tunnel register database. In the tunnel register database, data relating to tunnels installed on each rail is stored. In the tunnel register database illustrated in FIG. 7(B), a rail name of a rail where a tunnel is installed, kilometer post information representing the installation position of the tunnel on the rail by a kilometer post, a name of the tunnel, information such as tunnel length, and an ID number of a drawing file of the tunnel structure are registered.

FIG. 7(C) is a diagram illustrating a configuration example of railway crossing register database. In the railway crossing register database, data relating to a railway crossing installed on each rail is registered. In the railway crossing register database illustrated in FIG. 7(C), a rail name of a rail where a railway crossing is installed, kilometer post information representing the installation position of the railway crossing in the rail by a kilometer post, and other information are registered.

FIG. 7(D) is a diagram illustrating a configuration example of traffic signal register database. In the traffic signal register database, data relating to a traffic signal installed on each rail is registered. In the traffic signal register database illustrated in FIG. 7(C), a rail name of a rail where a traffic signal is installed, kilometer post information representing the installation position of a traffic signal on the rail by a kilometer post and information showing whether the traffic signal is for up line or down line are registered.

FIG. 8 is a configuration diagram of the drawing database. Registered in the drawing database are facility design drawings that are created in construction of the railway facility or modified in a later repair work. In the drawing database, drawing data is registered for each drawing type, in association with a drawing ID. The drawing data includes a general drawing, a construction drawing, a bar arrangement drawing and the like. Here, there is a one-to-one correspondence between the drawing ID registered in the drawing database and the drawing ID registered in the register database of the railway facilities.

Figure 9:
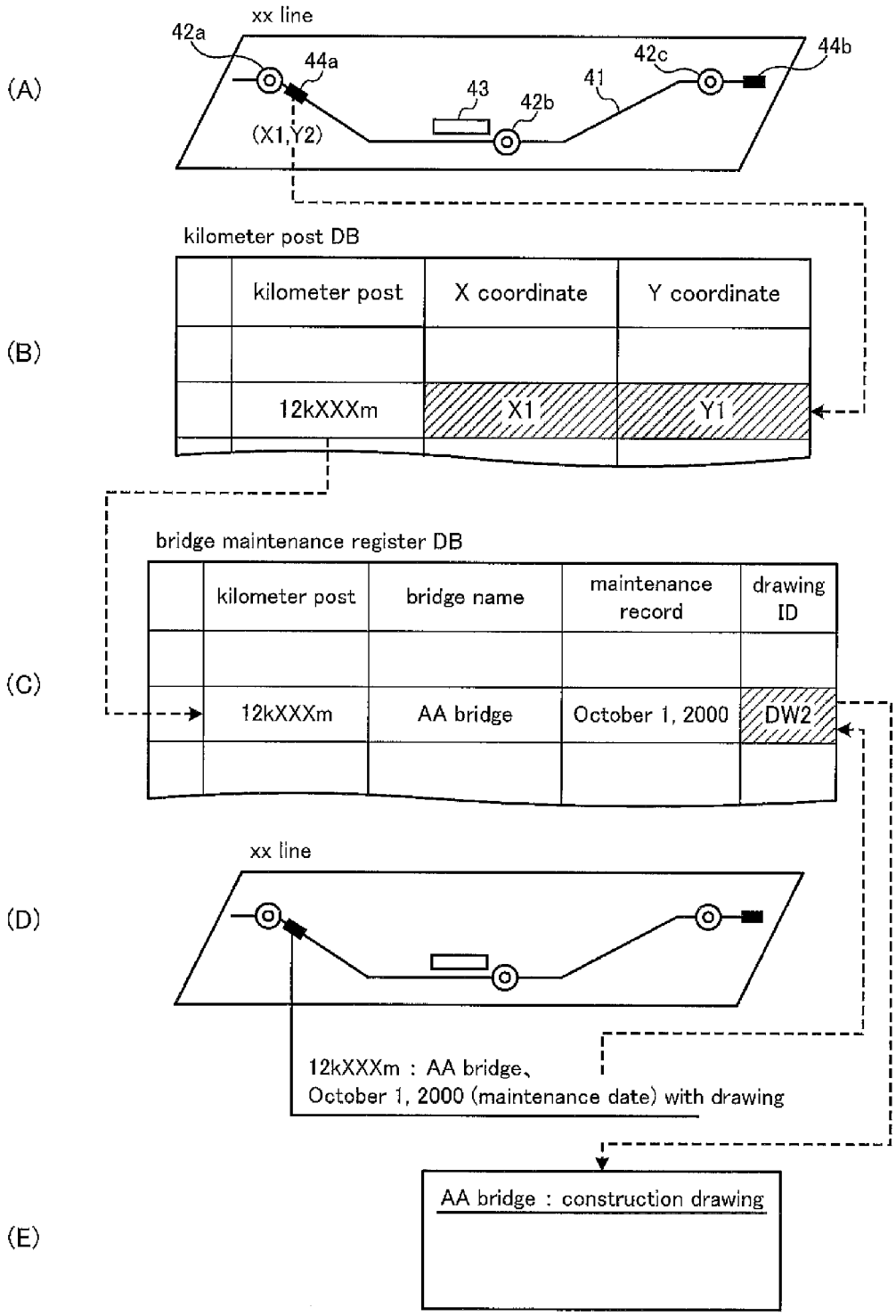
FIG. 9 is diagrams illustrating a link structure of GIS data for railway facilities and railway facility register data.

Here, with reference to FIG. 9, description is made about a link structure between railway facility management GIS data stored in the map data file 2 and various railway facility register data stored in the railway facility register database 3.

FIG. 9(A) is a diagram illustrating a display example of the railway basic information in a certain section of xx line. The kilometer posts 42*a* to 42*c* are displayed at fixed intervals along the center line of the rail 41, and the station house 43 is displayed in the midway of the rail 41. There are two bridges 44*a* and 44*b* displayed in the section of the rail 41 illustrated in the figure. Here, for simple explanation, the general map is not displayed. If the rail name, display section (or map range) and the item of railway facility are specified, display information of the specified item (layer number) is read from the railway basic information 6 in the corresponding section and the corresponding rail of the railway basic information file 2A, and then the display information is overlapped to display as illustrated on the screen of FIG. 9(A). At this time, the attribute information stored in the railway facility register database 3 is not displayed on the screen of FIG. 9(A). Next description is made about the data link structure by way of an example where the attribute information of one bridge 44*a* and the design/maintenance drawing are displayed from this state.

The coordinate data (X Y coordinates) on the map of the bridge 44*a* and the kilometer post on the xx rail of the bridge 44*a* are linked by the kilometer post database. In the example illustrated in FIG. 9(B), the coordinate data on the map of the bridge 44*a* is (X1, Y1) and the kilometer post corresponding to the coordinate data (X1, Y1) in the kilometer post database is 12 k xxx m.

In the bridge maintenance database, the bridge maintenance history data and the bridge kilometer post are associated with each other. In the example illustrated in FIG. 9(C), the bridge installed on the kilometer of 12 k xxx m of the xx rail has the name of "AA bridge", the last maintenance work date of "Oct. 1, 2000" and the drawing ID in the drawing database storing the bridge drawings of "DW2". That is, it can be understood that the bridge maintenance information (including the name) can be searched for by linking to the kilometer post of the bridge which is a search target of the attribute information.

In this system, the bridge maintenance work information of a bridge registered in the bridge maintenance database can be flagged and displayed on a display screen. In the example illustrated in FIG. 9(D), the bridge maintenance work information is flagged and displayed at the position of the bridge 44*a* (X1, Y1) as "12 k xxx m: AA bridge, Oct. 1, 2001 (maintenance date), with drawing".

The flagged and displayed maintenance work information has a link to the drawing ID (DW2). The drawing data of the AA bridge registered in the drawing database is linked to the phrase "with drawing". As illustrated in FIG. 8, as, in the drawing database, the drawing data of each railway facility is managed by the drawing ID, the drawing data of drawing ID=DW2 can be read out and displayed by clicking on the "with drawing". In the screen example of FIG. 9(E), the construction drawing of the AA bridge is displayed.

As described above, in the railway facility management system 1, all railway facilities registered in the railway basic information data file 2A are managed with use of kilometer post information without association with the coordinate data on the map of the railway facilities in the railway facility register database 3, and the attribute information of the railway facility (kilometer post, name, structure, drawings etc.) as a search target can be found easily.

Next description is made about the operation of the thus structured railway facility management system 1.

The client device 10 accesses the railway facility management system 1 via the communication network 5 to request for railway facility management information which a user desires. FIGS. 10(A) and 10(B) illustrate screen configurations for supporting input of the railway facility management information which the user desires in the client device 10. In the client device 10, when an application program for the railway facility management system 1 is started, the input support screen image M1 or M2 illustrated in FIG. 10(A) or 10(B) is displayed. Or the client device 10 may download the input support screen image M1 or M2 from the railway facility management system 1.

Figure 10:
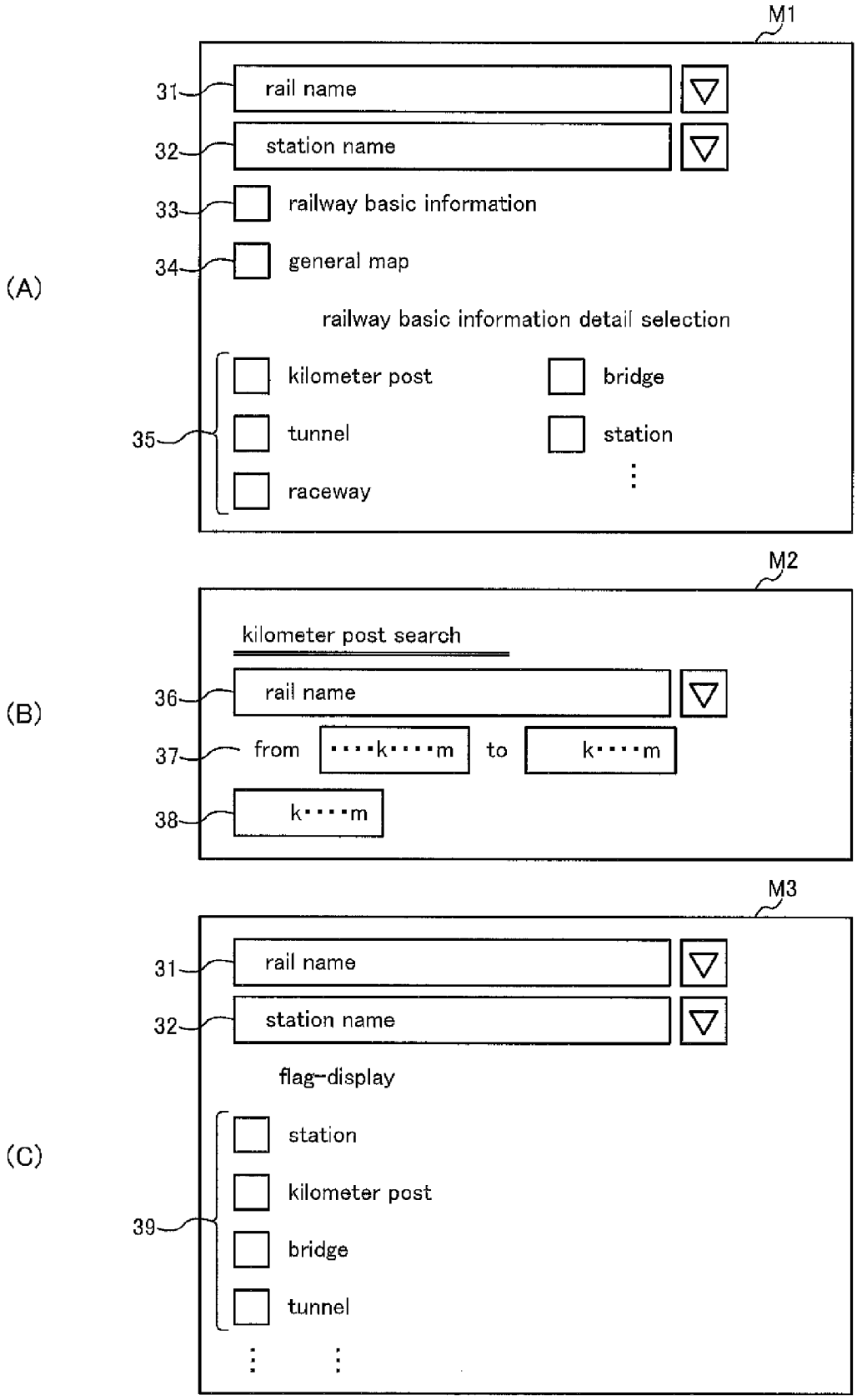
FIG. 10 is diagrams illustrating configuration examples of various screen images displayed on the client device.

In the example illustrated in FIG. 10(A), in the input support screen image M1, a line input box 31 for inputting a rail name, a station name input box 32 for inputting a station name, a basic information selection box 33 for selecting railway basic information and a general map selection box 34 for selecting a general map are provided. As to the railway facility information, detail item selection boxes 35 are provided for selecting any of railway facility items. In displaying all railway facility information centering a certain station, the user inputs a corresponding rail name in the line input box 31, and inputs a desired station name in the station name input box 32. By inputting the desired station name in the station name input box 32, it is possible to designate a map area centering the desired station in the system 1. As illustrated in FIG. 10, the rail name and the station name may be input by selecting them from a pull-down menu. When all of the items contained in the railway basic information are desired to be displayed, a checkmark is placed in the basic information selection box 33. When displaying the railway basic information and the general map with overlapping, the user further places a checkmark in the general map selection box 34. Furthermore, if he desires to display a part of the railway basic information selectively, the user select display items from the detail item selection boxes 35 and places a checkmark in each of them. Thus, the use of the input support screen image M1 enables the user easily to select desired display items and map area (section) to display.

Furthermore, the use of the input support screen image M2 illustrated in FIG. 10(B) enables to search for railway facility management information with a search key of the kilometer post and display the information. In the input support screen image M2, the line name input box 36 for inputting a rail name, a first kilometer post input box 37 for inputting a desired range of kilometer post, and a second kilometer input box 38 for inputting a kilometer post of a desired one location are provided. Through designation of the rail name and kilometer post in the system 1, the map area can be identified in the system 1 side.

Besides, the use of the input support screen image M3 illustrated in FIG. 10(C) enables to select, from displayed railway facilities, the type of railway facility of which the attribute information is to be flagged and displayed. In the input support screen image M3, flagging selection boxes 39 may be provided for selecting a railway facility to be flagged and displayed.

In this way, the request signal containing the selection information input by the user in the client device 10 is transmitted from the communication interface 25 to the railway facility management system 1 via the communication network 5.

In the railway facility management system 1, the request signal received by the receiving section 11 is supplied to the request analyzing section 12. The request analyzing section 12 analyzes the request signal to determine whether it is of obtaining map data from the map data file 2, of obtaining data such as attribute information from the railway facility register database 3 or both of them.

For example, in the input support screen image M1 illustrated in FIG. 10(A), where the basic information selection box 33 and the general map selection box 34 are selected, the railway basic information and general map in an area identified by the rail name (or station name) are requested to the GIS data obtaining section 13. The GIS data obtaining section 13 reads the general map data of the area from the general map data file 2B as well as the railway basic information of the same area as the general map data from the railway basic information data file 2A. The railway basic information has display data per railway facility as illustrated in FIGS. 4 and 5, therefore the display data of each requested railway facility is read out. For example, when display data of railway facilities 1 to 4 illustrated in FIGS. 5(A) to 5(D) are requested, the display data of the railway facilities 1 to 4 is read from the railway basic information data file 2A. Here, the user can select the railway facilities 1 to 4 with use of detail item selection boxes 35 illustrated in FIG. 10(A).

The display data creating section 16 creates the railway facility display data to be displayed on the client device 10 by overlapping the coordinates of the general map data and the railway facility display data, which are read from the general map data file 2B and the railway basic information data file 2A by the GIS data obtaining section 13, one on another. The transmitting section 17 transmits the railway facility display data to the client device 10 that is source of transmitting the request signal. Here, the railway facility display data may be created by overlapping the railway facility display data and the general map data in the client device 10.

According to the above configurations, a railway facility that the user desires is only selected in the detail item selection box 35 in the input support screen image M1 of FIG. 10(A), thereby the desired railway facility can be only displayed on the general map.

The attribute information of a desired railway facility among railway facilities displayed on the display screen illustrated in FIG. 9(A) can be retrieved from the railway facility register database 3. The operation of taking the attribute information of the railway facility from the railway facility register database 3 will be described with reference to FIGS. 9(A) to 9(E).

It is assumed that the railway facility management screen image illustrated in FIG. 9(A) is displayed on a display 24 of the client device 10. Then, the input section 23 is operated to select one bridge 44*a* from the railway facility management screen image of FIG. 9(A) and display attribute information of the bridge 44*a*. For example, a display request of the attribute information is issued by clicking the displayed point of the bridge 44*a*. The display request of the attribute information of the bridge 44*a* is transmitted with the coordinate data of the bridge 44*a* from the client device 10 to the railway facility management system 1.

In the railway facility management system 1, the request analyzing section 12 analyses the request signal from the client device 10 and recognizes it is a display request of the attribute information of the bridge 44*a*. The request analyzing section 12 instructs the register database search section 14 to search for the attribute information by designating coordinate data of the bridge 44*a*. The register database search section 14 receives the search request of the attribute information from the request analyzing section 12, refers to the kilometer post database 15, and obtains a rail name corresponding to the bridge 44*a* and kilometer post information of the railway facility on the rail by using the coordinate data of the railway facility as a key. Then, the register database search section 14 obtains the attribute information of the bridge such as "kilometer post", "bridge name", "maintenance record" and "drawing ID" from the bridge maintenance register database, based on the rail information of the railway facility and the kilometer post information. The attribute information of the bridge 44*a* obtained from the bridge maintenance register database is given to the display data creating section 16. The display data creating section 16 creates a display screen image with the attribute information overlapping on the railway facility management screen image currently displayed on the client device 10. For example, the screen image data is created for flagging and displaying the attribute information as illustrated in FIG. 9(D). The thus created railway facility management screen image data with the attribute information is transmitted from the transmitting section 17 to the client device 10. Consequently, at the client device 10, the railway facility management screen image with the attribute information flagged and displayed as illustrated in FIG. 9(D) is displayed on the display 24.

The above description is of the operation where the user has requested the attribute information of one bridge 44*a* in the railway facility management screen image displayed on the display 24. The attribute information of all railway facilities contained in the railway facility management screen image displayed on the display 24 can be requested per railway facility type. For example, in the input support screen image M3 illustrated in FIG. 10(C), a railway facility is selected to be flagged and displayed with use of the corresponding flagging selection box 39. The register database search section 14 may obtain the coordinate data on the map of the railway facility selected by the flagging selection box 39 from the client device 10, however may obtain the data not from the client device 10. For example, latest railway facility management screen data to be transmitted to the client device 10 may be cashed and the railway facility selected by the flagging selection box 39 may be extracted from the railway facility management screen data so that the coordinate data of the extracted railway facility can be obtained. Or, the coordinate information of the railway facility selected by the flagging selection box 39 may be requested to the GIS data obtaining section 13 so that the coordinate data of the railway facility may be obtained from the GIS data obtaining section 13. The attribute information of all of the selected railway facilities may be obtained by any of the above-mentioned processes.

Thus, according to the present embodiment, the location data (X Y coordinate data) on the general map and the drawing data of each railway facility are registered with the railway facility basic information 6 for displaying the railway facility on the general map. The rail name and kilometer post on the rail where the railway facility is installed and other attribute information are registered in the railway facility register database 3 for managing the attribute information of the railway facility. The kilometer post in each rail and coordinate data on the general map of the kilometer post are managed in the kilometer post database 15. Therefore, it is possible to reduce the complicated work of setting coordinate data on the general map of each of railway facilities registered in the railway facility register database 3 and to search for the attribute information based on the kilometer post of the railway facility. It is also possible to facilitate management of the attribute information of a huge number of railway facilities existing in each rail.

The above-mentioned railway facility management system may be in cooperation with an asset management system for managing information of the railway facilities (fixed asset register, asset drawing and the like) as electronic information. The railway facility information managed in the asset management system may be also given a kilometer post of each rail where the facility is installed. Therefore, the asset information managed by the asset management system and the map location information of the facility managed by the railway facility management system can be linked to each other via the kilometer post information.

In the above-described embodiment, the railway facility is in association with the coordinate data on the map of the railway facility in the kilometer post database (FIG. 6), however, the location of the railway facility on the general map and the kilometer post may be managed in association with each other in the railway basic information for defining the location and form of the railway facility on the general map. By managing the location of the railway facility on the general map and the kilometer post in association with each other in the railway basic information, the register database search section 14 can obtain a kilometer post corresponding to the display coordinates on the general map of the railway facility without referring to the kilometer post database (FIG. 6).

The description has been made about the railway facility management system 1 as above. However, the railway facility management system 1 is not intended for limiting the present invention. The present invention may be applicable to facility management of linearly managing facilities like a road facility and a power facility (electric feeder line). For example, the present invention may be applicable, like the railway facility management system 1, to such a system that many facilities (interchanges, bulletin boards, bridges, toll booths, service areas, filling station and the like) exist on and along one road like in an express highway or local street. These road facilities are managed in association with a distance (kilometer post) from a reference point on the express highway or local street, and besides, when there is an electronic register of each of the road facilities (interchanges, electronic boards, bridges, toll booths, service areas, filling station and the like), a data management section may be provided for managing the coordinate data on the general map of the road facility in association with the kilometer post.

The invention claimed is:

1. A facility management system using a geographic information system, comprising:

a facility GIS database configured with electronic map data for displaying a general map, and facility management GIS data containing data for identifying a location and a form of a facility located on a railway or a road on the general map;

a facility register database configured to manage records for each of a plurality of rails or roads, each record comprising a name of the rail or a road where the facility is located, a kilometer post representing a distance from a reference point specifically associated with that particular rail or road and located on the rail or the road where the facility is located, and attribute information of the facility other than the kilometer post and the name of the rail or the road;

an attribute search section configured to, when searching for the attribute information of the facility from the facility register database, search for attribute information of a search target facility from the facility register database by using kilometer post information assigned in advance to the search target facility; and a kilometer post information management section configured to manage records comprising the name of the rail or the road where the facility is located, the kilometer post on the rail or the road where the facility is located, and coordinate data of the facility on the general map, wherein, when searching for the attribute information of the facility from the facility register database, the attribute search section is configured to refer to the kilometer post information management section to obtain kilometer post information corresponding to the facility based on the coordinate data of the facility, and search for the attribute information of the facility from the facility register database by using the kilometer post information.

2. The facility management system according to claim 1, wherein the facility management GIS data contains kilometer post information assigned to the facility as well as the data for identifying the location and the form of the facility located on the railway or the road on the general map, and when searching for the attribute information of the facility from the facility register database, the attribute search section is configured to obtain kilometer post information of the search target facility from the facility management GIS data and search for the attribute information of the facility from the facility register database by using the obtained kilometer post information.

3. The facility management system according to claim 1, wherein the facility GIS database has a layer structure in which the facility management GIS data is layered by facility types.

4. The facility management system according to claim 1, further comprising: a receiving section configured to receive a request from a client device via a communication network; and a distributing section configured to distribute the electronic map data and the facility management GIS data, which are retrieved from the facility GIS database, to the client device in response to the request received by the receiving section.

5. The facility management system according to claim 4, wherein, when the client device requests attribute information of a facility by designating coordinate data of the facility, the attribute search section is configured to search for the attribute information of the facility designated by the client device from the facility register database and transmit the searched attribute information to the client device via the distributing section.

6. The facility management system according to claim 4, further comprising a data obtaining section configured to, when the client device requests attribute information of a facility by designating a facility type and a map area of the facility, obtain coordinate data of each facility which has the designated facility type and located in the designated map area, from the facility management GIS data, wherein the attribute search section is configured to search for the attribute information of each facility, of which the coordinate data is obtained by the data obtaining section, from the facility register database, and transmit the retrieved attribute information to the client device via the distributing section.

7. The facility management system according to claim 1, wherein the facility GIS database has a layer structure in which the facility management GIS data is layered by facility types.

8. The facility management system according to claim 2, wherein the facility GIS database has a layer structure in which the facility management GIS data is layered by facility types.

9. The facility management system according to claim 1, further comprising: a receiving section configured to receive a request from a client device via a communication network; and a distributing section configured to distribute the electronic map data and the facility management GIS data, which are retrieved from the facility GIS database, to the client device in response to the request received by the receiving section.

10. The facility management system according to claim 2, further comprising: a receiving section configured to receive a request from a client device via a communication network; and a distributing section configured to distribute the electronic map data and the facility management GIS data, which are retrieved from the facility GIS database, to the client device in response to the request received by the receiving section.

11. The facility management system according to claim 3, further comprising: a receiving section configured to receive a request from a client device via a communication network; and a distributing section configured to distribute the electronic map data and the facility management GIS data, which are retrieved from the facility GIS database, to the client device in response to the request received by the receiving section.

12. The facility management system according to claim 7, further comprising: a receiving section configured to receive a request from a client device via a communication network; and a distributing section configured to distribute the electronic map data and the facility management GIS data, which are retrieved from the facility GIS database, to the client device in response to the request received by the receiving section.

13. The facility management system according to claim 8, further comprising: a receiving section configured to receive a request from a client device via a communication network; and a distributing section configured to distribute the electronic map data and the facility management GIS data, which are retrieved from the facility GIS database, to the client device in response to the request received by the receiving section.

14. The facility management system according to claim 9, wherein, when the client device requests attribute information of a facility by designating coordinate data of the facility, the attribute search section is configured to search for the attribute information of the facility designated by the client device from the facility register database and transmit the searched attribute information to the client device via the distributing section.

15. The facility management system according to claim 10, wherein, when the client device requests attribute information of a facility by designating coordinate data of the facility, the attribute search section is configured to search for the attribute information of the facility designated by the client device from the facility register database and transmit the searched attribute information to the client device via the distributing section.

16. The facility management system according to claim 11, wherein, when the client device requests attribute information of a facility by designating coordinate data of the facility, the attribute search section is configured to search for the attribute information of the facility designated by the client device from the facility register database and transmit the searched attribute information to the client device via the distributing section.

17. The facility management system according to claim 12, wherein, when the client device requests attribute information of a facility by designating coordinate data of the facility, the attribute search section is configured to search for the attribute information of the facility designated by the client device from the facility register database and transmit the searched attribute information to the client device via the distributing section.

18. The facility management system according to claim 13, wherein, when the client device requests attribute information of a facility by designating coordinate data of the facility, the attribute search section is configured to search for the attribute information of the facility designated by the client device from the facility register database and transmit the searched attribute information to the client device via the distributing section.

19. The facility management system according to claim 9, further comprising a data obtaining section configured to, when the client device requests attribute information of a facility by designating a facility type and a map area of the facility, obtain coordinate data of each facility which has the designated facility type and located in the designated map area, from the facility management GIS data, wherein the attribute search section is configured to search for the attribute information of each facility, of which the coordinate data is obtained by the data obtaining section, from the facility register database, and transmit the retrieved attribute information to the client device via the distributing section.

20. The facility management system according to claim 10, further comprising a data obtaining section configured to, when the client device requests attribute information of a facility by designating a facility type and a map area of the facility, obtain coordinate data of each facility which has the designated facility type and located in the designated map area, from the facility management GIS data, wherein the attribute search section is configured to search for the attribute information of each facility, of which the coordinate data is obtained by the data obtaining section, from the facility register database, and transmit the retrieved attribute information to the client device via the distributing section.

21. The facility management system according to claim 11, further comprising a data obtaining section configured to, when the client device requests attribute information of a facility by designating a facility type and a map area of the facility, obtain coordinate data of each facility which has the designated facility type and located in the designated map area, from the facility management GIS data, wherein the attribute search section is configured to search for the attribute information of each facility, of which the coordinate data is obtained by the data obtaining section, from the facility register database, and transmit the retrieved attribute information to the client device via the distributing section.

22. The facility management system according to claim 12, further comprising a data obtaining section configured to, when the client device requests attribute information of a facility by designating a facility type and a map area of the facility, obtain coordinate data of each facility which has the designated facility type and located in the designated map area, from the facility management GIS data, wherein the attribute search section is configured to search for the attribute information of each facility, of which the coordinate data is obtained by the data obtaining section, from the facility register database, and transmit the retrieved attribute information to the client device via the distributing section.

23. The facility management system according to claim 13, further comprising a data obtaining section configured to, when the client device requests attribute information of a facility by designating a facility type and a map area of the facility, obtain coordinate data of each facility which has the designated facility type and located in the designated map area, from the facility management GIS data, wherein the attribute search section is configured to search for the attribute information of each facility, of which the coordinate data is obtained by the data obtaining section, from the facility register database, and transmit the retrieved attribute information to the client device via the distributing section.

24. A facility management system using a geographic information system, comprising:

a facility GIS database configured with electronic map data for displaying a general map, and facility management GIS data containing data for identifying at least one reference point location as orthogonal (x,y) coordinate data and a form of a facility located on a railway or a road on the general map at said reference point;

a facility register database configured to manage maintenance records comprising line identifier information corresponding to a name of a rail or a road where the facility is located, a kilometer post representing a distance from a reference point on the rail or the road where the facility is located, and attribute information of the facility other than the kilometer post and the name of the rail or the road;

a kilometer post linking table that defines associations between: (a) reference point locations identified in said facility GIS database expressed as orthogonal (x,y) coordinate data and (b) kilometer post locations corresponding to those reference point locations;

an attribute search section configured to search the facility register database using the line identifier information and the kilometer post information to retrieve a maintenance record and being further configured to use the kilometer post linking table to relate the retrieved maintenance record to at least one reference point location within the facility GIS database; and a kilometer post information management section configured to manage records comprising the name of the rail or the road where the facility is located, the kilometer post on the rail or the road where the facility is located, and coordinate data of the facility on the general map, wherein, when searching for the attribute information of the facility from the facility register database, the attribute search section is configured to refer to the kilometer post information management section to obtain kilometer post information corresponding to the facility based on the coordinate data of the facility, and search for the attribute information of the facility from the facility register database by using the kilometer post information.

25. The facility management system of claim 24, wherein the facility GIS database and facility register database are configured as a layered architecture, wherein said orthogonal (x,y) coordinate data are stored in a first layer and wherein said kilometer post locations are stored in at least one second layer, the first and second layers being sized such that when the first and second layers are overlaid upon one another, reference points expressed as orthogonal (x,y) coordinate data in said linking table overlie their associated kilometer post locations.

* * * * *